US008591618B2

(12) United States Patent
Shirai et al.

(10) Patent No.: US 8,591,618 B2
(45) Date of Patent: Nov. 26, 2013

(54) AIR CLEANER

(75) Inventors: Ken Shirai, Tokyo (JP); Takahiro Yamazaki, Tokyo (JP); Hisato Onodera, Tokyo (JP); Koichirou Ogura, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 58 days.

(21) Appl. No.: 13/344,920

(22) Filed: Jan. 6, 2012

(65) Prior Publication Data

US 2012/0174889 A1 Jul. 12, 2012

(30) Foreign Application Priority Data

Jan. 7, 2011 (JP) ..... 2011-001890

(51) Int. Cl.
*B01D 46/00* (2006.01)

(52) U.S. Cl.
USPC ..... 55/385.3; 55/424; 55/DIG. 28; 123/198 E

(58) Field of Classification Search
USPC ..... 55/385.1, 385.3, DIG. 3; 15/347, 352; 123/41.56, 198 E, 41.7; 74/519, 522.5, 74/526
See application file for complete search history.

(56) References Cited

U.S. PATENT DOCUMENTS

| | | | | |
|---|---|---|---|---|
| 4,600,418 | A | 7/1986 | Gommel et al. | |
| 5,582,146 | A | 12/1996 | Linsbauer et al. | |
| 7,370,388 | B2 * | 5/2008 | Yuasa et al. | 15/347 |
| 7,776,119 | B2 * | 8/2010 | Notaras et al. | 55/385.3 |
| 7,780,754 | B2 * | 8/2010 | Hefele et al. | 55/385.1 |
| 2001/0025471 | A1 | 10/2001 | Fries et al. | |
| 2005/0050867 | A1 * | 3/2005 | Taomo et al. | 55/385.3 |
| 2005/0150199 | A1 * | 7/2005 | Michele et al. | 55/385.1 |
| 2009/0038277 | A1 * | 2/2009 | Huang | 55/385.1 |

FOREIGN PATENT DOCUMENTS

| | | |
|---|---|---|
| DE | 44 27 739 | 2/1996 |
| FR | 2 567 199 | 1/1986 |
| JP | 38-21007 Y | 10/1938 |
| JP | 63-75559 U | 5/1988 |

OTHER PUBLICATIONS

Extended European Search Report for EP Application No. 12000031.0, dated Apr. 25, 2012 (corresponds to U.S. Appl. No. 13/344,920).

* cited by examiner

*Primary Examiner* — Duane Smith
*Assistant Examiner* — Minh-Chau Pham
(74) *Attorney, Agent, or Firm* — Baker Botts L.L.P.

(57) ABSTRACT

There is provided an air cleaner that is capable of suppressing or reducing malfunctions and problems caused by mixed fuel that back flows from a carburetor, thereby prolonging filter life, reducing filter maintenance frequency, etc. The air cleaner comprises: a fuel accumulation part; and a back flow guide member that guides the mixed fuel that back flows into the air cleaner, wherein the plurality of return flow paths are provided in a radial fashion about the cleaner outlet.

8 Claims, 7 Drawing Sheets

AIR CLEANER

FIELD

The present application relates to an air cleaner disposed immediately upstream of a carburetor in an intake system of an engine, and, more particularly, to an air cleaner adapted to suppress or reduce malfunctions and problems caused by mixed fuel (gasoline and lubricant oil) that back flows from the carburetor.

BACKGROUND INFORMATION

By way of example, with respect to such portable power working machine as chain saws, brush cutters, etc., a two-stroke gasoline engine, e.g., an approximately 25-100 cc small air-cooled internal combustion engine, is ordinarily provided within the main housing as a power source for driving the operating part, e.g., the saw chain, etc. Further, a carburetor as a fuel supplying and regulating means is provided in the intake system of such an engine, while an air cleaner for cleaning outside-air that is brought in by removing dust therefrom is disposed immediately upstream of this carburetor.

A conventional example of such an air cleaner is described below with reference to FIG. 3 where the rear portion of a chain saw is shown along with a portion of a two-stroke gasoline engine mounted thereon, the two-stroke gasoline engine being of a reverse-scavenging system having a total of four scavenging ports with two each on the left and right.

With respect to chain saw 50 shown in the diagram, a lateral L-shaped top handle 54, into which a throttle lock lever and a throttle trigger are incorporated, is so disposed as to span the upper surface part and rear part of a main housing 52. A cooling fan (not shown) driven by an engine 60 is disposed inside the main housing 52. A portion of the air brought into the main housing 52 by this cooling fan is brought into a cylinder 62 of the engine 60 via an air cleaner 10' and carburetor 65 disposed at the rear part of the top handle 54 and main housing 52.

The engine 60 is mounted sideways within the main housing 52 with its intake port 63 on the upper side and its head part (combustion chamber) 64 facing rearward. The carburetor 65 is connected further upstream than the intake port 63 via a vibration-absorbent air pipe 66 comprising a synthetic rubber material, and the air cleaner 10' is connected immediately upstream of the carburetor 65.

The air cleaner 10' comprises: a synthetic resin case 11 comprising a bottom wall 15 with a substantially inverted-V-shaped cross-section [a bottom wall 15A on the side of the carburetor 65 (upper side) and a bottom wall 15B on the side of a cleaner inlet 16 (lower side)] and a perimeter side-wall 15C; a thick plate-shaped filter (filtering element) 12 that is so disposed as to cover the upper opening of the case 11; a synthetic resin cover 13 that is disposed in such a manner as to be sandwiched the filter 12 between the case 11 and the cover 13; and a screw member 18 that is screwed into an internal thread part 17 formed around a boundary between the carburetor-side bottom wall 15A of the case 11 and the cleaner inlet-side bottom wall 15B in order to attach this cover 13, wherein the cover 13 and the filter 12 may be removed by loosening the screw member 18. It is noted that the internal thread part 17 has its upper part (a boss part 17*a*) protrude upward from the bottom wall 15 (15A, 15B).

In addition, as can be seen in the case 11 portion of the air cleaner 10' shown in FIG. 4, a cleaner outlet 20 is so provided in the carburetor-side bottom wall 15A of the case 11 as to be continuous with an intake port 67*a* of an internal passage 67 in the carburetor 65. An upper end part (a boss part 20*a*) of the cleaner outlet 20 protrudes slightly upward from the upper surface of the bottom wall 15A. On the bottom wall 15A is disposed a back flow guide member 19 made of a metal plate and for preventing mixed fuel (discussed later) that back flows from the carburetor 65 from traveling towards the filter 12.

As can be seen in the plan view in FIG. 5A showing an attached state and the perspective view in FIG. 5B, this guide member 19 comprises: a bent plate part 19A of an inverted lip groove shape that lies above the center of the cleaner outlet 20; and a crescent-shaped plate part 19B that extends from an upper plate part 19*a* of the bent plate part 19A in such a manner as to bend slightly downward towards the internal thread part 17. Screwing plate parts 19*c*, 19*c* that bend outward are respectively provided at the lower ends of both side plate parts 19*b*, 19*b* of the bent plate part 19A. Set screws 22 are screwed into the carburetor 65 via through-holes 19*d* respectively provided in the screwing plate parts 19*c*, 19*c*, and via insertion holes 29, 29 each with a boss part 29*a* that are provided in the bottom wall 15A of the case 11. The back flow guide member 19 and the case 11 are thus fastened together and affixed to the carburetor 65.

In addition, in order to define a fuel accumulation part 25 for collecting and accumulating fuel that back flows from the carburetor 65, upright plate parts 27, 28 are provided on the cleaner inlet-side bottom wall 15B of the case 11.

SUMMARY

However, with respect to the intake system of the engine 60 described above, unless some countermeasure is taken, mixed fuel (gasoline and lubricant oil) that has been atomized at the carburetor 65 back flows into the case 11 via the cleaner outlet 20 due to back flow from the intake port 63. This back flow is represented with broken line arrows in FIG. 4. The mixed fuel that has back flowed into the case 11 via the cleaner outlet 20 is guided by the back flow guide member 19 (as shown by the broken line arrows in FIG. 3), and is collected and accumulated in the fuel accumulation part 25 via the inner wall surfaces (i.e., the perimeter side-wall 15C, the bottom wall 15) of the case 11, etc., while a portion thereof simply adheres to the filter 12. In addition, although a portion of the accumulated mixed fuel is returned to the carburetor 65 by being sucked towards the cleaner outlet 20 due to the intake negative pressure at the time of intake following the back flow, a portion thereof remains in the fuel accumulation part 25 and adheres to the filter 12 as it overflows from the fuel accumulation part 25, for example.

Of the mixed fuel that adheres to the filter 12, only the gasoline evaporates, and the oil part alone remains at the case 11 and the filter 12. Consequently, the airflow resistance of the filter 12 increases (intake air amount decreases), the boost pressure exerted on the nozzle of the carburetor 65 increases, fuel flow increases, and the air-fuel mixture for combustion becomes excessively concentrated. Thus, not only does output decrease and performance worsen, but the filter 12 will also require frequent maintenance (replacement, etc.) by the operator. By way of example, with the engine mentioned above (27 cc engine displacement), the filter 12 will require maintenance approximately every 20 hours of use. If such maintenance is neglected, not only will the device body become dirty due to the oil that overflows from the case 11, but soil pollution may also be caused (such malfunctions in lawn mowers, etc., are viewed unfavorably particularly in regions where rice is produced in large amounts).

As can be seen in, by way of example, JP Utility Model Publication (Kokoku) No. 38-21007 Y (1963) (Patent Document 1), JP Utility Model Application Publication (Kokai) No. 63-75559 U (1988) (Patent Document 2), etc., providing a fuel accumulation part that collects and accumulates mixed fuel that back flows from the carburetor, and a return flow path for returning the fuel accumulated in the fuel accumulation part back towards the carburetor utilizing intake negative pressure has already been proposed among other things in order to suppress or reduce malfunctions and problems caused by mixed fuel that back flows from the carburetor as discussed above. However, the above on its own cannot sufficiently address the above-mentioned malfunctions and problems, particularly with respect to such portable power equipment as chain saws, lawn mowers, etc., where the attitude of the device body (i.e., engine, air cleaner) tends to vary significantly (e.g., tends to be tilted, turned over, etc.).

The disclosed subject matter provides an air cleaner that is capable of suppressing or reducing malfunctions and problems caused by mixed fuel that back flows from the carburetor, thereby prolonging filter life, reducing filter maintenance frequency, etc.

An air cleaner according to an embodiment of the present invention is disposed immediately upstream of a carburetor in an intake system of an engine. The air cleaner includes: a fuel accumulation part that is fanned near a cleaner outlet provided in a cleaner bottom wall located towards the carburetor, the fuel accumulation part being adapted to collect and accumulate mixed fuel that back flows from the carburetor; a back flow guide member that guides the mixed fuel that back flows into the air cleaner via the cleaner outlet not towards a filter but towards the fuel accumulation part; and a plurality of return flow paths, each of which comprises one end that is in communication with the fuel accumulation part and another end that is in communication with the cleaner outlet so as to return the mixed fuel that accumulates in the fuel accumulation part back towards the carburetor utilizing intake negative pressure, wherein the plurality of return flow paths are formed in a radial fashion about the cleaner outlet.

In the same or another embodiment, the fuel accumulation part comprise a weir-like plate part erected on the cleaner bottom wall.

In the same or another embodiment, the plurality of return flow paths each comprise a flow path forming plate part that is erected on the cleaner bottom wall and whose upper end surface comprises a sloped surface that slopes downward towards the cleaner outlet.

With an air cleaner according to an embodiment of the present invention, in addition to a fuel accumulation part that collects and accumulates mixed fuel that back flows from a carburetor, there is fanned, in a radial fashion about a cleaner outlet, a plurality of return flow paths, each of which comprises one end that is in communication with the fuel accumulation part and another end that is in communication with the cleaner outlet. As a result, the mixed fuel that accumulates in the fuel accumulation part is thereafter efficiently returned towards the carburetor by means of intake negative pressure via the plurality of return flow paths formed in a radial fashion.

Thus, the amount of mixed fuel that adheres to the filter is greatly reduced as compared to a conventional air cleaner. Consequently, it is possible to effectively suppress or reduce malfunctions and problems caused by mixed fuel that back flows from the carburetor, thereby prolonging filter life, reducing filter maintenance frequency, etc.

In addition, as the return flow paths each comprise a flow path forming plate part that is erected on the cleaner bottom wall, the return flow paths consequently also serve as flow regulating plates that regulate the flow of the intake air, thereby reducing the amount of fuel that adheres to the filter without causing a drop in output, and so forth.

In addition, since the return flow paths are formed in a radial fashion, it is possible to reliably return the back flow mixed fuel to the carburetor regardless of the attitude of the equipment (i.e., engine, air cleaner) (e.g., even if it is significantly tilted, or turned over).

BRIEF DESCRIPTION OF THE DRAWINGS

FIG. 5A is a plan view of an attached state, and FIG. 5B is a perspective view.

DETAILED DESCRIPTION

Embodiments of the present invention are described below with reference to the drawings.

Figure 1A:
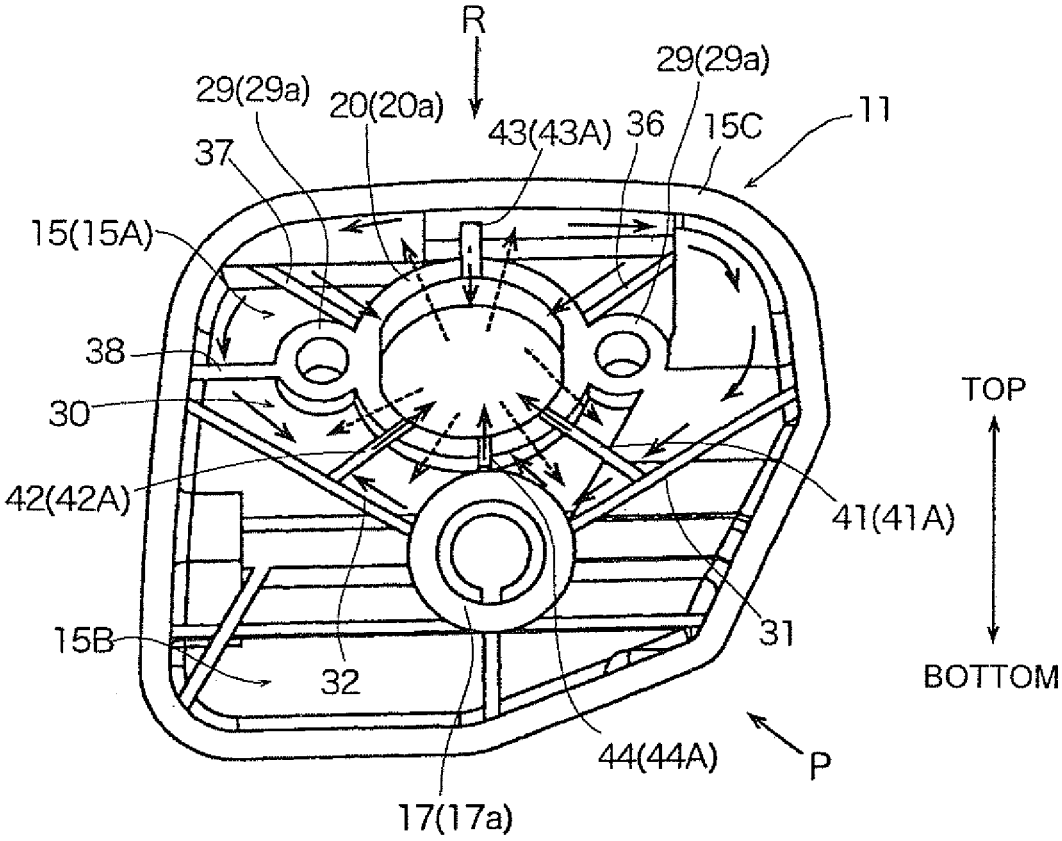
FIG. 1A is a plan view showing the case portion of an embodiment of an air cleaner according to the present invention.
Figure 1B:
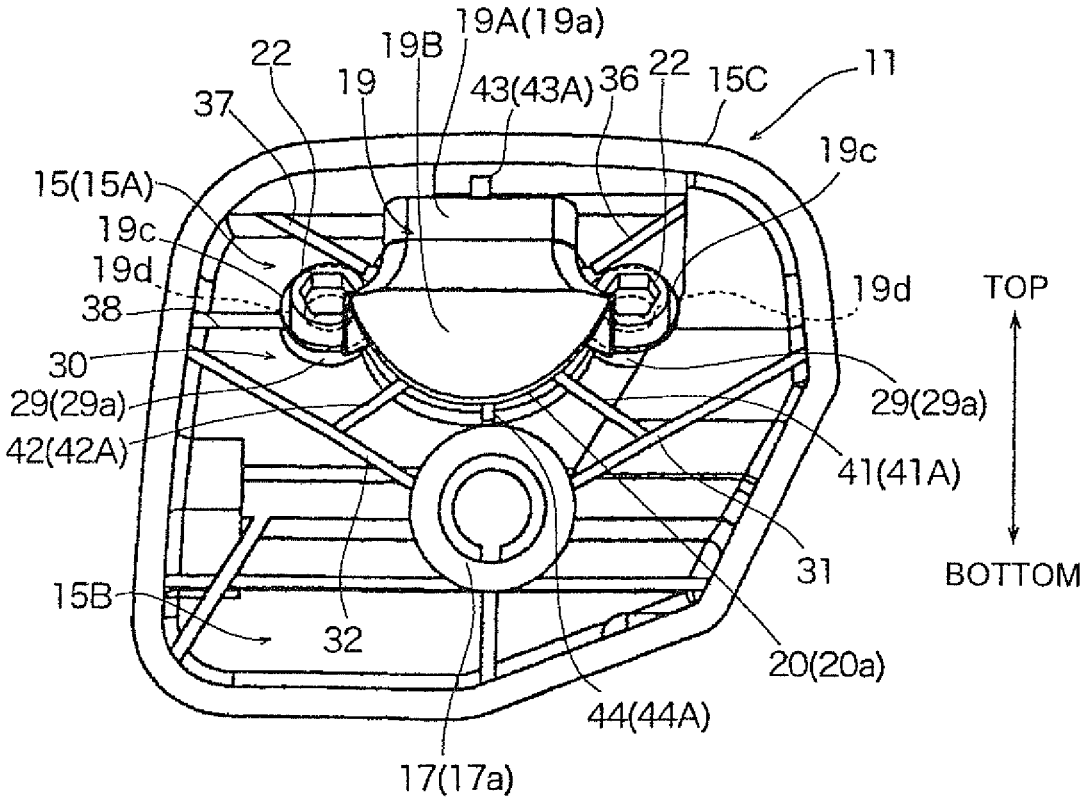
FIG. 1B is a plan view showing a state where a back flow guide member is attached to the case shown in FIG. 1A.
Figure 2A:
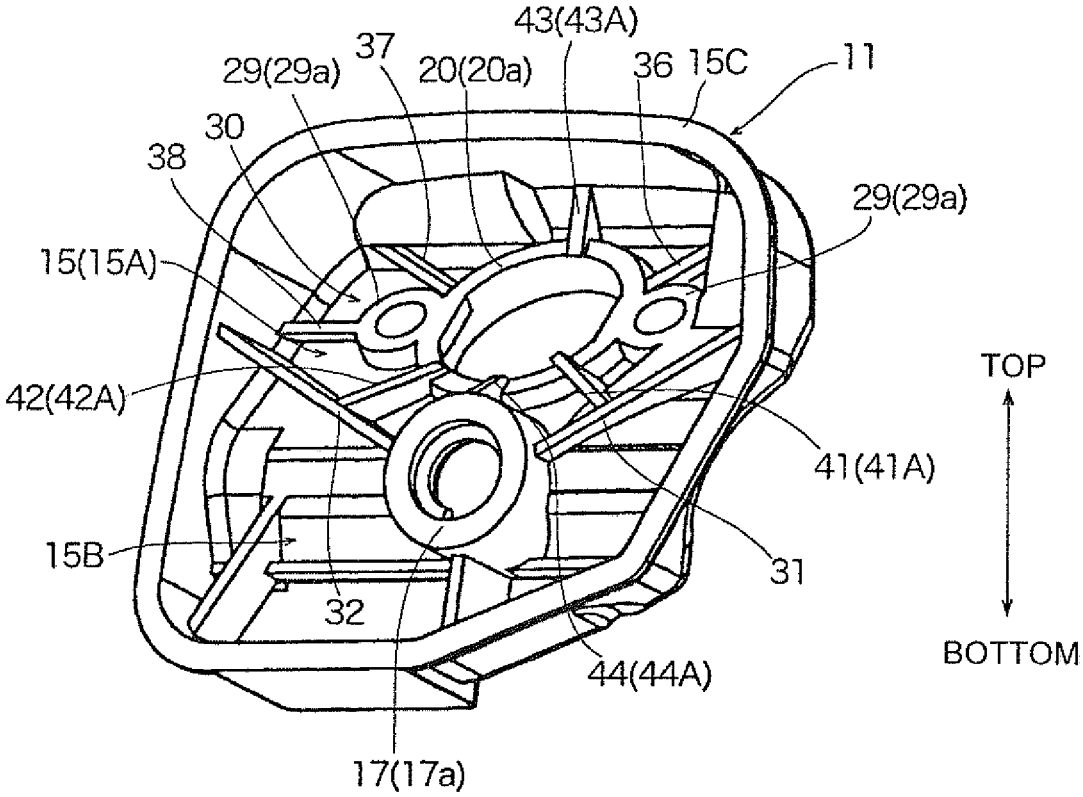
FIG. 2A is a perspective view of FIG. 1A as viewed in the P-direction.
Figure 2B:
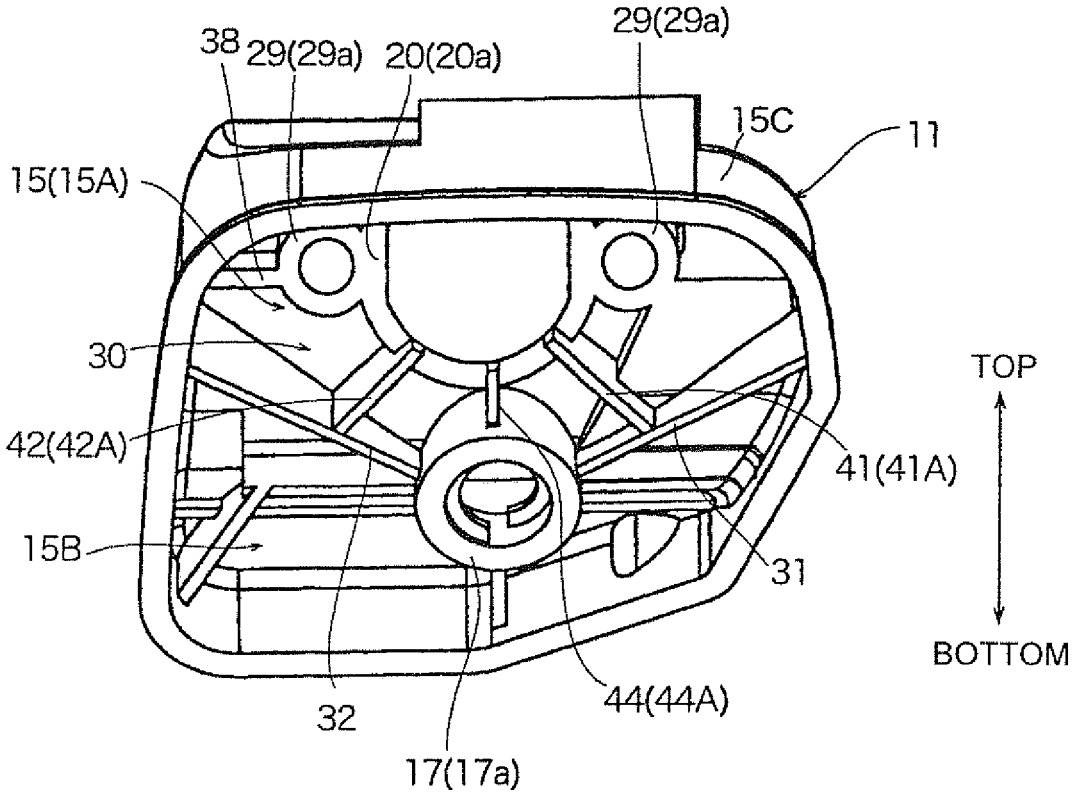
FIG. 2B is a perspective view of FIG. 1A as viewed in the R-direction.

FIG. 1A is a plan view showing the case portion of one embodiment of an air cleaner according to the present invention. FIG. 1B is a plan view showing a state where a back flow guide member is attached to the case shown in FIG. 1A. FIG. 2A is a perspective view of FIG. 1A as viewed in the P-direction. FIG. 2B is a perspective view of FIG. 1A as viewed in the R-direction.

Figure 3:
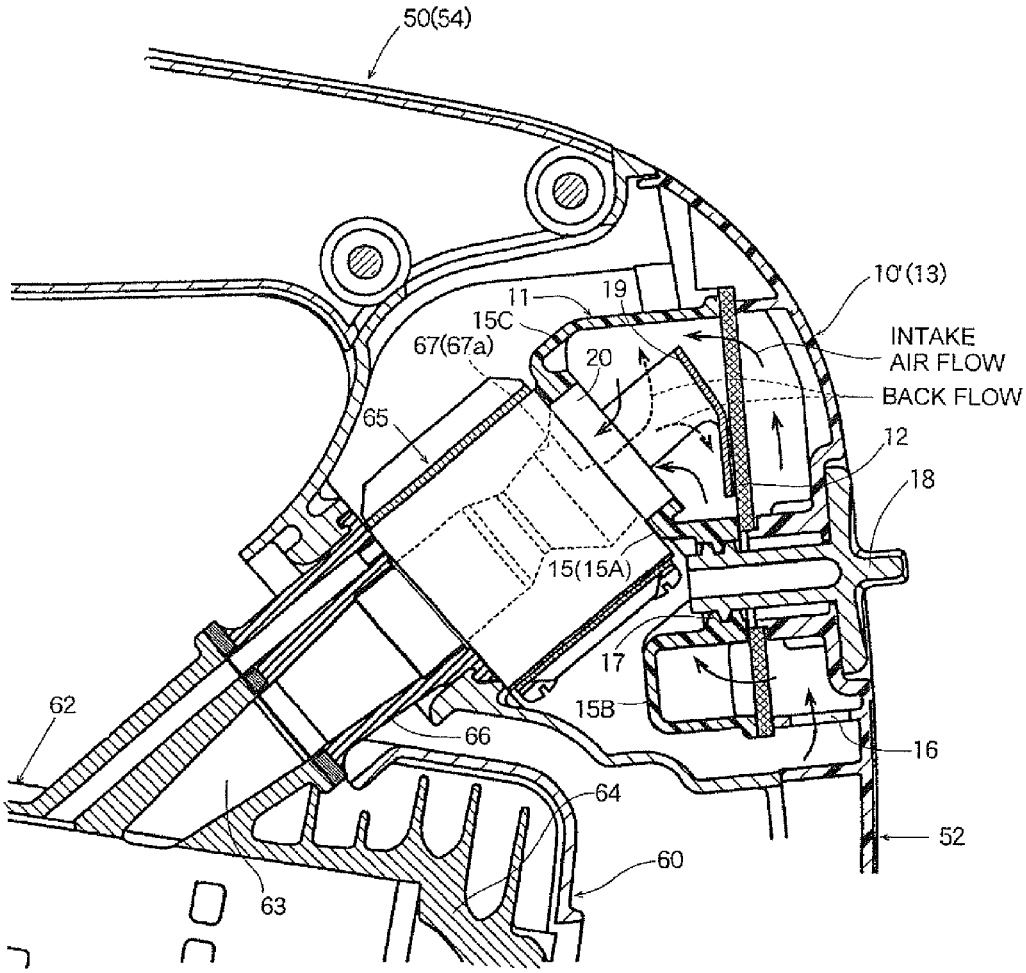
FIG. 3 is a sectional view showing a conventional example of an air cleaner along with the rear portion of a chain saw and a portion of a two-stroke gasoline engine mounted thereon.
Figure 4:
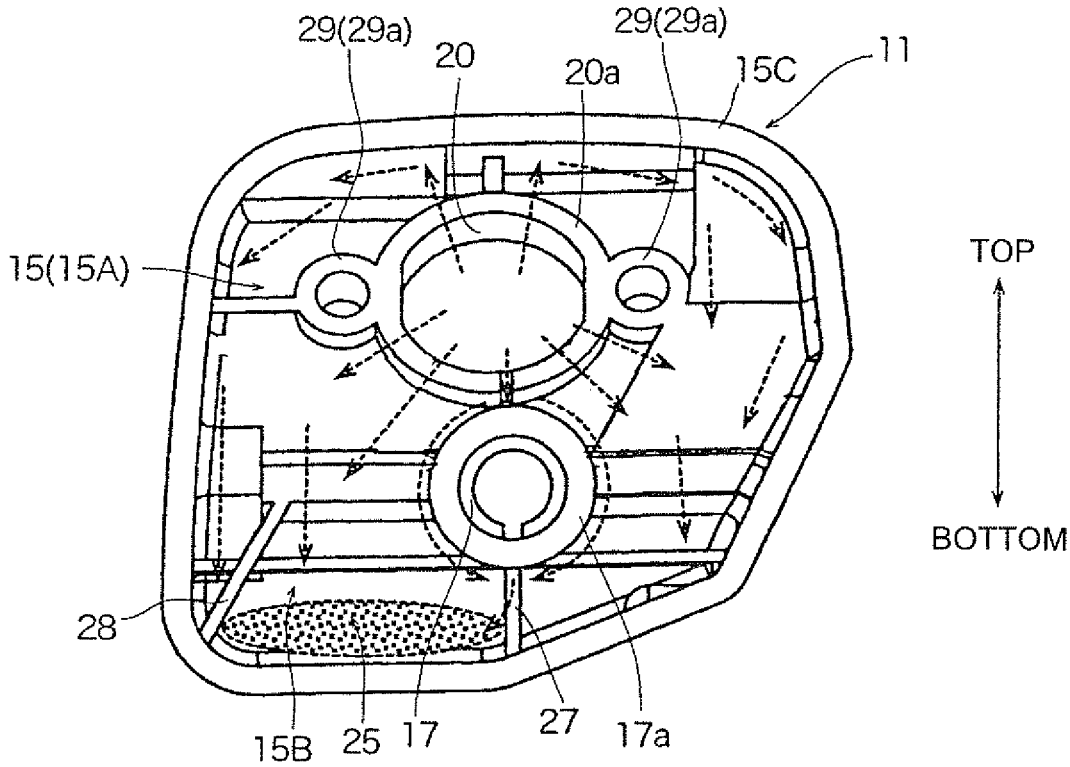
FIG. 4 is a plan view showing the case portion of the conventional air cleaner shown in FIG. 3.
Figure 5A:
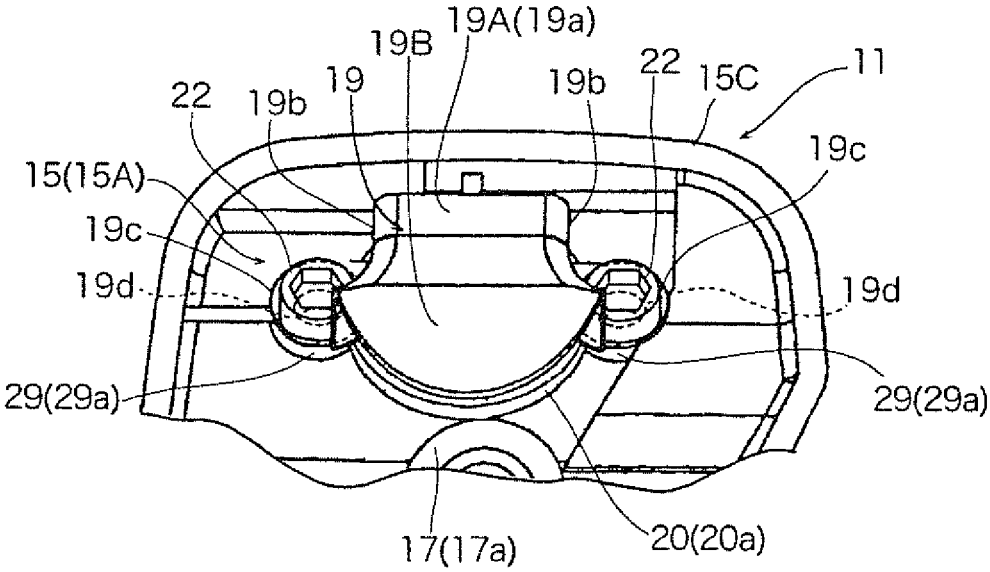
FIGS. 5A and 5B show the back flow guide member used in the conventional air cleaner shown in FIG. 3, where
Figure 5B:
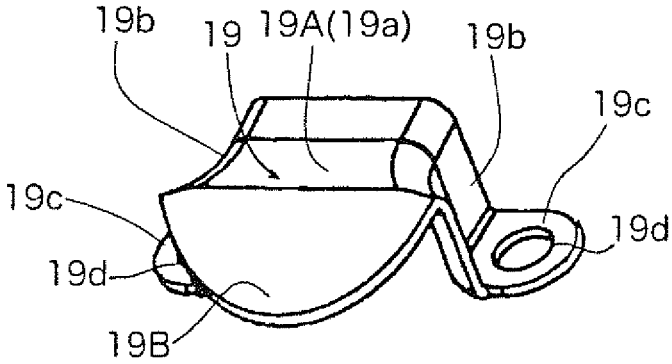

An air cleaner 10 of the present embodiment is similar to the air cleaner 10' in the conventional example shown in FIG. 3 and FIG. 4 discussed above in terms of its basic structure, that is, it comprises the case 11, the filter 12, the cover 3, the screw member 18, the guide member 19, etc. It only differs in terms of the structure(s) on the bottom wall 15 of the case 11. As such, parts that correspond to the parts of the air cleaner 10' in the conventional example are designated with like reference numerals while omitting duplicate descriptions therefor. The description below is provided mainly with respect to points where the two differ.

With respect to the case 11 of the air cleaner 10 of the present embodiment, in order to collect and accumulate mixed fuel that back flows from the carburetor 65, a fuel accumulation part 30 is formed near, and so as to surround, the cleaner outlet 20 provided in the carburetor-side bottom wall 15A. The fuel accumulation part 30 is formed mainly of the carburetor-side bottom wall 15A, the perimeter side-wall 15C that forms a perimeter portion thereof, and two weir-like plate parts 31, 32 that are erected on the bottom wall 15 so as to separate the carburetor-side bottom wall 15A and the cleaner inlet-side bottom wall 15B and in the shape of a V that is turned sideways and symmetrical about a horizontal line. Each of the weir-like plate parts 31, 32 is such that one end is continuous with the perimeter side-wall 15C while the other end is continuous with the boss part 17*a* of the internal thread part 17, and is thus configured to stem the back flow mixed fuel so that it does not flow out from the bottom wall 15A towards the bottom wall 15B. It is noted that, in the fuel accumulation part 30, rib-like partition plate parts 36, 37, 38 are also erected in such a manner as to connect parts near the boss parts 29*a* of the insertion holes 29, 29 with the perimeter side-wall 15C, the insertion holes 29, 29 being for securing the guide member 19 with screws. The height of each of the rib-like partition plate parts 36, 37, 38 is approximately the same as the heights of the boss part 20*a* of the cleaner outlet 20 and of the boss parts 29*a* of the insertion holes 29, 29.

In addition, in order to return the fuel that accumulates in the fuel accumulation part 30 back towards the carburetor 65 utilizing intake negative pressure, the fuel accumulation part 30 is provided with return flow paths 41, 42, 43, 44, each of which comprises one end that is in communication with the cleaner outlet 20 and another end that is in communication with the fuel accumulation part 30.

The return flow paths 41, 42, 43, 44 respectively comprise flow path forming plate parts 41 A, 42A, 43A, 44A that are erected in a radial fashion about the cleaner outlet 20 and whose respective upper end surfaces each comprise a flat (not curved) sloped surface that slopes downward towards the cleaner outlet 20. Each of the flow path forming plate parts 41A, 42A, 43A, 44A has one end that is continuous with the cleaner outlet 20, and its sloped surface is located at a higher position than the boss part 20*a* of the cleaner outlet 20. The other end of the flow path forming plate part 41A is continuous with the weir-like plate part 31. The other end of the flow path forming plate part 42A is continuous with the weir-like plate part 32. The other end of the flow path forming plate part 43A is continuous with the perimeter side-wall 15C. The other end of the flow path forming plate part 44A is continuous with the boss part 17*a* of the internal thread part 17.

With respect to the air cleaner 10 of the present embodiment thus configured, due to the back flow from the intake port 63, the mixed fuel (gasoline and lubricant oil) that has been atomized at the carburetor 65 back flows into the case 11. This back flow is represented with broken line arrows in FIG. 1A. The back flow mixed fuel is guided by the guide member 19 not towards the filter 12 but towards the fuel accumulation part 30 and is accumulated therein, while a portion thereof hits the perimeter wall of the fuel accumulation part 30 (i.e., the perimeter side-wall 15C and the weir-like plate parts 31, 32) and is bounced back. The mixed fuel that is accumulated in the fuel accumulation part 30 is sucked towards the cleaner outlet 20 upon intake following the back flow due to the intake negative pressure. In this case, of the mixed fuel that is accumulated in the fuel accumulation part 30, the portions that are in contact with the flow path forming plate parts 41A, 42A, 43A, 44A with the slopes that slope downward towards the cleaner outlet 20 and which form the return flow paths 41, 42, 43, 44 are more readily sucked, and are thus drawn into the cleaner outlet 20 first. Since their flow speed becomes faster as they are drawn in, other portions of the mixed fuel are, one after another, also pulled towards the flow path forming plate parts 41A, 42A, 43A, 44A with the slopes, and are returned to the carburetor 65 via the cleaner outlet 20. This flow that follows back flow is represented with solid line arrows in FIG. 1A.

Thus, with respect to the air cleaner 10 of the present embodiment, in addition to the fuel accumulation part 30 that accumulates mixed fuel that back flows from the carburetor 65, the plurality of return flow paths 41, 42, 43, 44, respectively comprising the flow path forming plate parts 41A, 42A, 43A, 44A with the slopes, are formed in a radial fashion about the cleaner outlet 20. Consequently, the mixed fuel that accumulates in the fuel accumulation part 30 is returned towards the carburetor 65 efficiently via the cleaner outlet 20 by means of the intake negative pressure generated immediately after back flow.

Thus, the amount of mixed fuel that adheres to the filter 12 is reduced significantly as compared to the conventional example. As a result, it is possible to suppress or reduce malfunctions and problems caused by mixed fuel that back flows from the carburetor, thereby prolonging filter life, reducing filter maintenance frequency, etc. It is noted that whereas the filter 12 required maintenance approximately every 20 hours of use in the conventional example, it has been confirmed through experiments that with the air cleaner 10 of the present embodiment, the filter 12 does not require maintenance for up to approximately five times as long (i.e., 100 hours).

In addition, by virtue of the fact that the amount of adhesion to the filter 12 is reduced, fuel efficiency may be improved and the emission of toxic substances reduced.

Further, since the return flow paths 41, 42, 43, 44 respectively comprise the flow path forming plate parts 41A, 42A, 43A, 44A erected on the cleaner bottom wall 15A in a radial fashion, the flow path forming plate parts 41A, 42A, 43A, 44A also serve as flow regulating plates that regulate the flow of intake air. Consequently, the amount of fuel that adheres to the filter 12 may be reduced without causing output to drop, among other things.

In addition, since the flow path forming plate parts 41A, 42A, 43A, 44A are erected in a radial fashion, the mixed fuel that has back flowed may be returned to the carburetor reliably regardless of what attitude the equipment (i.e., engine, air cleaner) may be placed in (e.g., even if it is tilted significantly, or turned over).

It is noted that, in the present embodiment, the fuel accumulation part 30 comprises the two weir-like plate parts 31, 32. However, the structure of the fuel accumulation part 30 is by no means limited to any particular shape so long as it is capable of accumulating the back flow mixed fuel near the cleaner outlet 20. By way of example, a level difference may simply be provided between the bottom wall 15A and the bottom wall 15B so as to prevent the back flow mixed fuel from flowing out towards the bottom wall 15B from the bottom wall 15A.

Further, the back flow guide member is also not limited to that of the embodiment above, and its shape, material, etc., are not limited in any particular way so long as they allow the guiding of the mixed fuel that has back flowed into the air cleaner (case 11) not towards the filter 12 but towards the fuel accumulation part 30. In addition, it may also be molded integrally with the synthetic resin case 11.

While there have been described what are believe to be the preferred embodiments of the invention, those skilled in the art will recognize that other changes and modifications may be made thereto without departing from the spirit of the invention, and it is intended to claim all such changes and modifications as fall within the true scope of the invention.

LIST OF REFERENCE NUMERALS

10 Air cleaner
11 Case
12 Filter
13 Cover
19 Back flow guide member
20 Cleaner outlet
30 Fuel accumulation part
31, 32 Weir-like plate part
41, 42, 43, 44 Return flow path
41A, 42A, 43A, 44A Flow path forming plate part

What is claimed is:

1. An air cleaner for placement upstream of a carburetor in an intake system of an engine, the air cleaner comprising:

a fuel accumulation part formed near, and so as to surround, a cleaner outlet provided in a cleaner bottom wall located towards the carburetor, the fuel accumulation part being adapted to accumulate mixed fuel that back flows from the carburetor;

a back flow guide member that guides the mixed fuel that back flows into the air cleaner via the cleaner outlet not towards a filter but towards the fuel accumulation part; and a plurality of return flow features, each of which comprises one end that is in communication with the cleaner outlet and another end that is in communication with the fuel accumulation part so as to return the mixed fuel that accumulates in the fuel accumulation part back towards the carburetor utilizing intake negative pressure, wherein the plurality of return flow features are formed in a radial fashion about the cleaner outlet.

2. The air cleaner according to claim 1, wherein the fuel accumulation part comprises a weir-like plate part erected on the cleaner bottom wall.

3. The air cleaner according to claim 1, wherein the plurality of return flow features each comprise a flow path forming plate part erected on the cleaner bottom wall and whose upper end surface comprises a sloped surface that slopes downward towards the cleaner outlet.

4. The air cleaner according to claim 2, wherein the plurality of return flow features each comprise a flow path forming plate part erected on the cleaner bottom wall and whose upper end surface comprises a sloped surface that slopes downward towards the cleaner outlet.

5. An engine including a carburetor and an air cleaner disposed immediately upstream of the carburetor, the air cleaner comprising:

a fuel accumulation part formed near, and so as to surround, a cleaner outlet provided in a cleaner bottom wall located towards the carburetor, the fuel accumulation part being adapted to accumulate mixed fuel that back flows from the carburetor;

a back flow guide member that guides the mixed fuel that back flows into the air cleaner via the cleaner outlet not towards a filter but towards the fuel accumulation part; and a plurality of return flow features, each of which comprises one end that is in communication with the cleaner outlet and another end that is in communication with the fuel accumulation part so as to return the mixed fuel that accumulates in the fuel accumulation part back towards the carburetor utilizing intake negative pressure, wherein the plurality of return flow features are formed in a radial fashion about the cleaner outlet.

6. The engine of claim 5, wherein the fuel accumulation part comprises a weir-like plate part erected on the cleaner bottom wall.

7. The engine of claim 5, wherein the plurality of return flow features each comprise a flow path forming plate part erected on the cleaner bottom wall and whose upper end surface comprises a sloped surface that slopes downward towards the cleaner outlet.

8. The engine of claim 6, wherein the plurality of return flow features each comprise a flow path forming plate part erected on the cleaner bottom wall and whose upper end surface comprises a sloped surface that slopes downward towards the cleaner outlet.

* * * * *